US012490851B2

(12) United States Patent
Mazyck

(10) Patent No.: US 12,490,851 B2
(45) Date of Patent: Dec. 9, 2025

(54) DEVICE FOR REINFORCING A HANGER AND METHOD FOR HANGING A GARMENT USING A HANGER REINFORCED WITH THE DEVICE

(71) Applicant: Darren Mazyck, Pembroke Pines, FL (US)

(72) Inventor: Darren Mazyck, Pembroke Pines, FL (US)

( * ) Notice: Subject to any disclaimer, the term of this patent is extended or adjusted under 35 U.S.C. 154(b) by 0 days.

(21) Appl. No.: 18/537,919

(22) Filed: Dec. 13, 2023

(65) Prior Publication Data

US 2025/0194837 A1 Jun. 19, 2025

(51) Int. Cl.
*A47G 25/32* (2006.01)
*A47G 25/14* (2006.01)

(52) U.S. Cl.
CPC ..... *A47G 25/32* (2013.01); *A47G 25/1442* (2013.01)

(58) Field of Classification Search
CPC ..... A47G 25/1442; A47G 25/145; A47G 25/1457; A47G 25/32
USPC ..... 223/DIG. 4
See application file for complete search history.

(56) References Cited

U.S. PATENT DOCUMENTS 2,556,461 A * 6/1951 Baron ..... A47G 25/32 24/716
3,804,310 A * 4/1974 Wheeler ..... A45B 3/06 294/142
4,266,705 A * 5/1981 Wheeler ..... A47G 25/1457 294/169

FOREIGN PATENT DOCUMENTS

FR 2862197 A1 * 5/2005 ..... A47G 25/1457

* cited by examiner

*Primary Examiner* — Nathan E Durham
(74) *Attorney, Agent, or Firm* — Fleit Intellectual Property; Paul D. Bianco

(57) ABSTRACT

Device for reinforcing a hanger. The device reinforces and/or strengthens a conventional hanger such that the conventional hanger can more readily support heavy and/or bulky garments such as suits and winter clothing. Also included is a method for hanging a garment using a hanger reinforced with the device.

15 Claims, 3 Drawing Sheets

DEVICE FOR REINFORCING A HANGER AND METHOD FOR HANGING A GARMENT USING A HANGER REINFORCED WITH THE DEVICE

FIELD OF THE INVENTION

The invention generally relates to tools for clothing care and organization; particularly to hangers for displaying, transporting, laundering, and/or storing garments; and most particularly to a device for reinforcing and/or strengthening conventional garment hangers.

BACKGROUND

Storage and organization of clothing is a universal and seemingly never-ending pursuit. Tools to aid with this storage and organization, such as hangers and hooks, were developed progressively over the years. The wire-based hanger, having a pair of shoulder portions flanking a central hook, was first introduced in the middle of the nineteenth century. The central hook is designed to rest on a rod, or another support, and the shoulder portions mimic the structure of human shoulders such that when a garment is hung on a hanger it is hung in the same orientation in which it would be worn thus eliminating wrinkles and increasing longevity of the garment.

Modern clothing is produced in an extensive variety of styles, sizes, and purposes, for example, bathing suits and cover ups for swimming and heavy sweaters and outerwear for skiing. Despite the variation in clothing, the basic structure of the hanger has remained the same for decades. A hanger that is strong enough to support a bathing suit likely does not have sufficient strength to support a bulky winter coat. The only known conventional solution is to use a bigger hanger for hanging the bulky winter coat. Thus, an assortment of hangers of differing sizes is required to accommodate every article of clothing in a typical closet.

A device capable of strengthening a hanger would be advantageous in streamlining closet organization since it would eliminate the need for obtaining hangers in multiple sizes.

SUMMARY OF THE INVENTION

The invention described herein provides a device capable of strengthening a conventional hanger/garment hanger by reinforcing the structure of the conventional hanger/garment hanger. A hanger reinforced with this device can more readily support heavy and/or bulky garments such as suits and winter clothing and thus eliminate the need for obtaining hangers in multiple sizes. The reinforced hanger can accommodate all articles of clothing.

The phrases "reinforcing device" and "device for reinforcing a hanger" are used interchangeably herein.

The terms "hanger" and "garment hanger" are used interchangeably herein.

The term "suitable" as used herein refers to a thing appropriate for a desired use.

In a most general aspect, the invention provides an innovative tool for clothing care and organization.

In a general aspect, the invention provides a reinforcing device for a hanger.

In a general aspect, the invention provides a reinforced garment hanger.

In another general aspect, the invention provides a device that reinforces and/or strengthens a conventional hanger such that the conventional hanger can more readily support heavy and/or bulky garments such as suits and winter clothing.

In a general aspect, the invention provides a method for hanging a garment using a hanger reinforced with the described device.

In an aspect, the invention provides a device for reinforcing a hanger. The device includes a hook portion; a shank portion; a first fastening element; a second fastening element; and a securing element. The hook portion and the shank portion are preferably made of a metal material but can be made of any suitable material. The first and second fastening elements are configured for engaging with a corresponding hook portion of the hanger and fastening the device to the hanger. The securing element has a tube portion configured for encircling the shank portion. The interior of the tube portion has threads for engaging with threads on at least a portion of an end area opposite the hook portion. Through this threaded connection, the securing element is configured and arranged for adjustable positioning along the shank portion such that device can securely attach to hangers having a range of sizes and styles.

In an embodiment of the device, the first fastening element is an annular ring integral with and extending outwardly from the hook portion approximate an end thereof and the second fastening element is a U-shaped element integral with and extending outwardly from the hook portion at a distance from the annular ring.

In an embodiment of the device, the securing element has an elongated portion extending at a right angle from the surface of the tube portion. Further, the elongated portion has an end portion opposite the tube portion that curves and extends upwardly from the elongated portion forming a support surface having an L-shape. When the device is engaged with the hanger, this support surface stabilizes the hanger for a secure fit of the device to the hanger.

In an embodiment, the device includes at least one cap covering an exposed end of at least one of the hook portion, the shank portion, the second fastening element, and the securing element. Any or all exposed ends can be capped. Furthermore, the exposed ends can be capped in any combination. A cap is preferably made of a plastic material but can be made from any suitable material.

In another aspect, the reinforcing device and at least one hanger can be packaged in containers and assembled in kits together with instructions for use.

In yet another aspect, the invention provides a method for hanging a garment on a reinforced hanger. The method includes providing the described device; providing a hanger; engaging the first fastening element with the corresponding hook portion of the hanger; engaging the second fastening element with the corresponding hook portion of the hanger; positioning and tightening the securing element around the shank portion such that the device is secured, thereby obtaining the reinforced hanger; and placing the garment on the reinforced hanger. A non-limiting example of a first fastening element is an annular ring and a non-limiting example of a second fastening element is a U-shaped element.

The above-listed aspects are exemplary embodiments only and are not meant to limit the invention. Other objectives and advantages of this invention will become apparent from the following description taken in conjunction with the accompanying drawings, wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

A more complete understanding of the present invention may be obtained by references to the accompanying drawings when considered in conjunction with the subsequent detailed description. The embodiments illustrated in the drawings are intended only to exemplify the invention and should not be construed as limiting the invention to the illustrated embodiments.

DETAILED DESCRIPTION OF THE INVENTION

Figure 1:
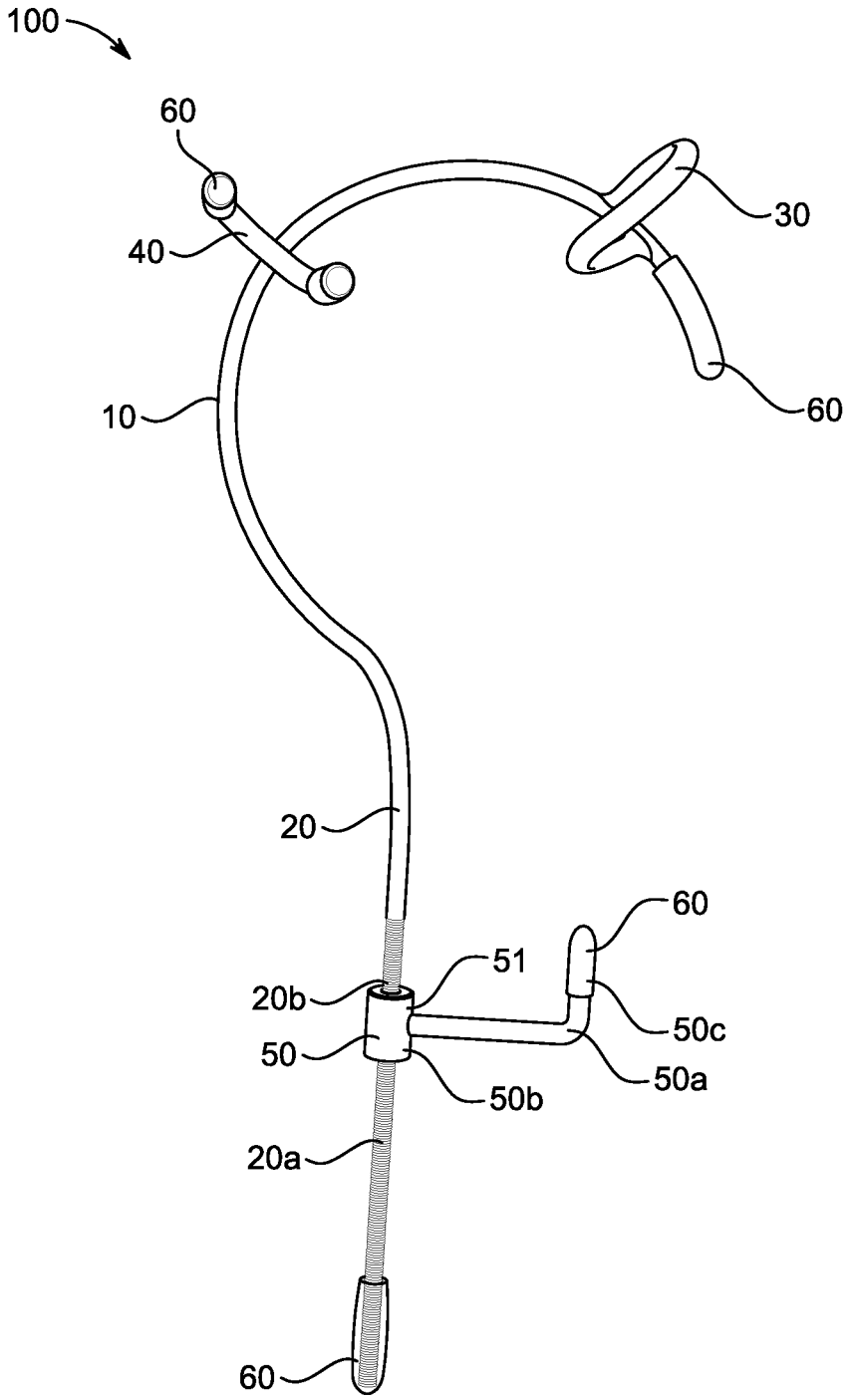
FIG. 1 shows a frontal view of an embodiment of the reinforcing device according to the invention.

As required, embodiments are disclosed herein; however, it is to be understood that the disclosed embodiments are merely examples and that the devices and methods described below can be embodied in various forms. Therefore, specific structural and functional details disclosed herein are not to be interpreted as limiting, but merely as a representative basis for teaching one skilled in the art to variously employ the present subject matter in virtually any appropriately detailed structure and function. Further, the terms and phrases used herein are not intended to be limiting, but rather, to provide an understandable description of the concepts.

It can be advantageous to set forth definitions of certain words and phrases used throughout this disclosure. The terms "a" or "an", as used herein, are employed to describe elements and components described herein. This is done merely for convenience and to give a general sense of the scope of the disclosure. This description should be read to include one or at least one and the singular also includes the plural unless it is obvious that it is meant otherwise. The term plurality, as used herein, is defined as two or more than two. The term another, as used herein, is defined as at least a second or more.

The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of: A, B, and C" includes any of the following combinations: A, B, or C; A and B; A and C; B and C; and A, B, and C.

Note that not all of the activities described herein or in the examples are required, that a portion of a specific activity may not be required, and that one or more further activities can be performed in addition to those described. Still further, the order in which activities are listed is not necessarily the order in which they are performed.

For the purpose of promoting an understanding of the principles of the invention, reference will now be made to embodiments illustrated herein and specific language will be used to describe the same. It will nevertheless be understood that no limitation of the scope of the invention is thereby intended. Any alterations and further modification in the described reinforcing devices, reinforcing elements, hangers, garment hangers, kits, and/or methods along with any further application of the principles of the invention as described herein, are contemplated as would normally occur to one skilled in the art to which the invention relates.

With reference to the figures, reinforcing device 100 engages with hanger 200 to strengthen the structure such that hanger 200 can more readily support heavy and/or bulky garments such as suits and winter clothing.

As shown in FIG. 1, the reinforcing device 100 includes a hook portion 10 and a shank portion 20 extending from hook portion 10. Threads 20*a* extend along at least a portion of an end of shank portion 20 opposite hook portion 10. Reinforcing device 100 is preferably made from a metal but can be made from any material capable of performing the reinforcing function of reinforcing device 100. A first fastening element, annular ring 30, is integral with and extends outwardly from hook portion 10 at an end thereof. A second fastening element, U-shaped element 40, is integral with and extends outwardly from hook portion 10 at a distance from annular ring 30. The first and second fastening elements 30, 40 are configured for engaging a corresponding hook portion 10*a* of hanger 200. Securing element 50 has an elongated portion 50*a* extending at a right angle from a surface 51 of a tube portion 50*b*. Tube portion 50*b* is configured for encircling shank portion 20. An end portion 50*c* of the elongated portion 50*a* opposite the tube portion 50*b* curves and extends upwardly forming an L-shape support. An interior of tube portion 50*b* has threads 20*b* for adjustably engaging with corresponding threads 20*a* of shank portion 20. This threaded engagement allows securing element 50 to be adjustably positioned along any portion of the threaded end of shank portion 20 for accommodating different sizes and styles of hangers. Exposed and/or sharp ends of elements 10, 20, 40, and 50 can be covered by caps 60. Caps 60 are preferably made of a plastic material but can be made from any suitable material.

Reinforcing device 100 is attached to hanger 200 by placing annular ring 30 over the hook 10*a* of hanger 200, placing the hook 10*a* of hanger 200 within U-shaped element 40, and positioning and tightening securing element 50 around shank portion 20 such that a top portion 201 of hanger 200 is supported by the L-shape support of securing element 50. After hanger 200 is reinforced by attachment of reinforcing device 100, a garment may be hung on the reinforced hanger in the usual manner.

Figure 2:
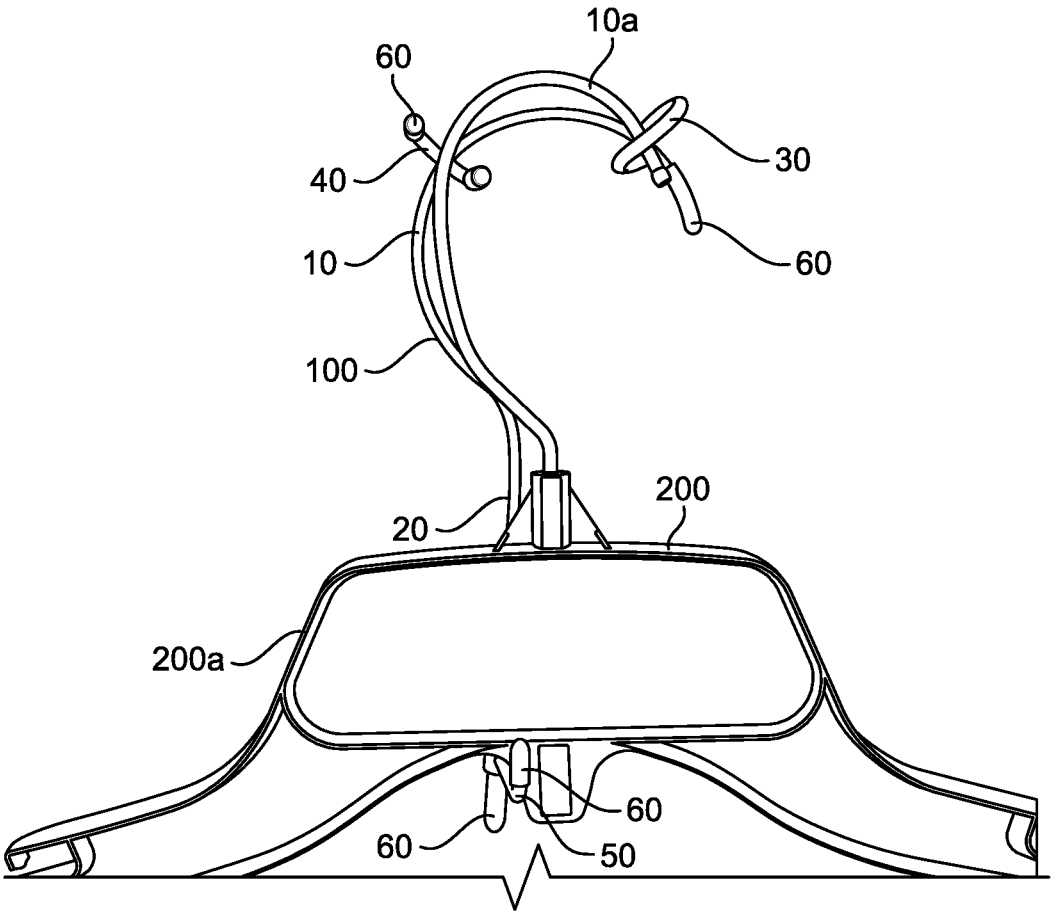
FIG. 2 shows the reinforcing device of FIG. 1 attached to a hanger as viewed from a first side of the hanger in which the device is viewed as being behind the hook of the hanger.

FIG. 2 shows reinforcing device 100 attached and secured to hanger 200 as viewed from a first side 200*a* of the hanger 200. The first side 200*a* is the side in which the reinforcing device 100 appears positioned behind the hook 10*a* of hanger 200.

Figure 3:
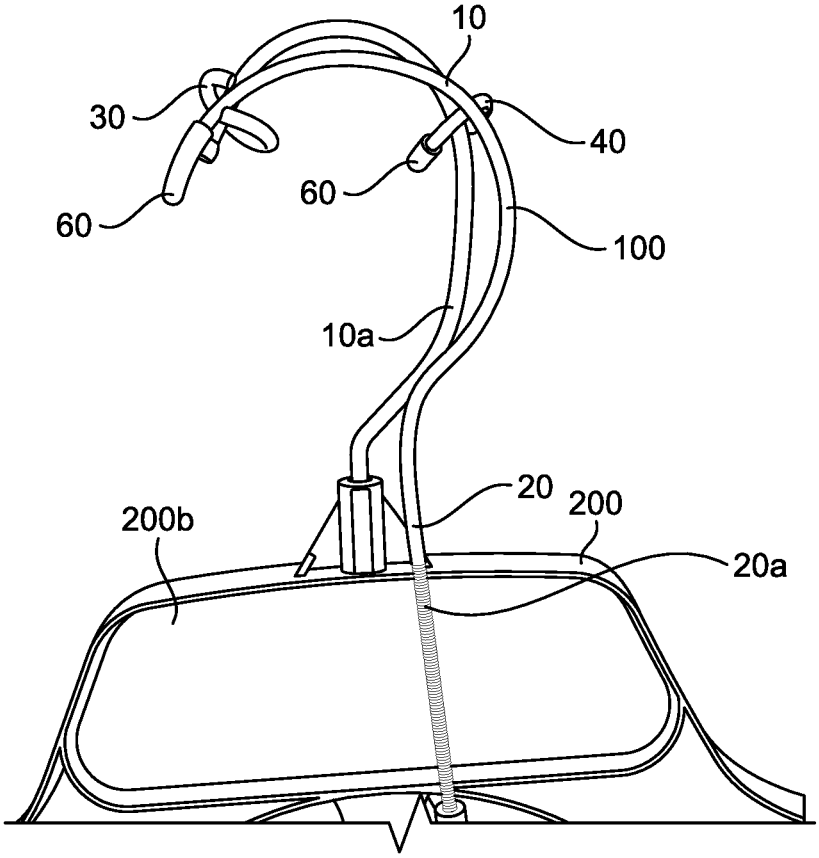
FIG. 3 shows the reinforcing device of FIG. 1 attached to a hanger as viewed from a second side of the hanger in which the device is viewed as being in front of the hook of the hanger.

FIG. 3 shows reinforcing device 100 attached and secured to hanger 200 as viewed from a second side 200*b* of the hanger 200. The second side 200*b* is the side in which the reinforcing device 100 appears positioned in front of the hook 10*a* of hanger 200.

Employing reinforcing device 100 with conventional garment hangers reduces the number and sizes of hangers necessary for streamlining closet organization and reducing clutter.

All references cited herein are expressly incorporated by reference in their entirety. It will be appreciated by persons skilled in the art that the present disclosure is not limited to what has been particularly shown and described herein above. In addition, unless mention was made above to the contrary, it should be noted that all of the accompanying drawings are not to scale. There are many different features to the present disclosure and it is contemplated that these features may be used together or separately. Thus, the disclosure should not be limited to any particular combination of features or to a particular application of the disclosure. Further, it should be understood that variations and modifications within the spirit and scope of the disclosure might occur to those skilled in the art to which the disclosure pertains. Accordingly, all expedient modifications readily attainable by one versed in the art from the disclosure set forth herein that are within the scope and spirit of the present disclosure are to be included as further embodiments of the present disclosure.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended representative claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct, or as an essential feature of any or all the representative claims.

After reading the disclosure, skilled artisans will appreciate that certain features are, for clarity, described herein in the context of separate embodiments can also be provided in combination in a single embodiment. Conversely, various features that are, for brevity, described in the context of a single embodiment, can also be provided separately or in any sub-combination. Further, any references to values stated in ranges include each and every value within that range.

The above discussion is meant to be illustrative of the principles and various embodiments of the present invention. Numerous variations and modifications will become apparent to those skilled in the art once the above disclosure is fully appreciated. It is intended that the following representative claims be interpreted to embrace all such variations and modifications.

What is claimed is:

1. A device for reinforcing a hanger comprising:

a hook portion;

a shank portion extending from the hook portion, the shank portion having threads on at least a portion of an end area opposite the hook portion;

a first fastening element configured for engaging with a corresponding hook portion of the hanger;

a second fastening element configured for engaging with a corresponding hook portion of the hanger; and a securing element having a tube portion configured for encircling the shank portion, an interior of the tube portion having threads for engaging with the threads on at least a portion of an end area opposite the hook portion, wherein the securing element has an elongated portion extending at a right angle from a surface of the tube portion, the elongated portion having an end portion opposite the tube portion that curves and extends upwardly from the elongated portion forming a support surface.

2. The device according to claim 1, wherein the hook portion and the shank portion are made of a metal material.

3. The device according to claim 1, wherein the securing element is configured and arranged for adjustable positioning along the shank portion.

4. The device according to claim 1, wherein the first fastening element is an annular ring integral with and extending outwardly from the hook portion approximate an end thereof.

5. The device according to claim 4, wherein the second fastening element is a U-shaped element integral with and extending outwardly from the hook portion at a distance from the annular ring.

6. The device according to claim 1, further comprising at least one cap covering an exposed end of at least one of the hook portion, the shank portion, the second fastening element, and the securing element.

7. The device according to claim 6, wherein the at least one cap is made of a plastic material.

8. A kit comprising at least one hanger and a device for reinforcing the at least one hanger, wherein the device comprises:

a hook portion;

a shank portion extending from the hook portion, the shank portion having threads on at least a portion of an end area opposite the hook portion;

a first fastening element configured for engaging with a corresponding hook portion of the at least one hanger;

a second fastening element configured for engaging with a corresponding hook portion of the at least one hanger; and a securing element having a tube portion configured for encircling the shank portion, an interior of the tube portion having threads for engaging with the threads on at least a portion of an end area opposite the hook portion, wherein the securing element has an elongated portion extending at a right angle from a surface of the tube portion, the elongated portion having an end portion opposite the tube portion that curves and extends upwardly from the elongated portion forming a support surface.

9. A method for hanging a garment on a reinforced hanger, the method comprising:

providing the device according to claim 1;

providing a hanger;

engaging the first fastening element with the corresponding hook portion of the hanger;

engaging the second fastening element with the corresponding hook portion of the hanger;

positioning and tightening the securing element around the shank portion such that the device is secured thereby obtaining the reinforced hanger; and placing the garment on the reinforced hanger.

10. A device for reinforcing a hanger comprising:

a hook portion;

a shank portion extending from the hook portion, the shank portion having threads on at least a portion of an end area opposite the hook portion;

a first fastening element configured for engaging with a corresponding hook portion of the hanger, the first fastening element an annular ring integral with and extending outwardly from the hook portion approximate an end thereof;

a second fastening element configured for engaging with a corresponding hook portion of the hanger, the second fastening element a U-shaped element integral with and extending outwardly from the hook portion at a distance from the annular ring; and a securing element having an elongated portion extending at a right angle from a surface of a tube portion, the tube portion configured for encircling the shank portion and having interior threads for engaging with the threads on at least a portion of an end area opposite the hook portion; and wherein the elongated portion has an end portion opposite the tube portion that curves and extends upwardly from the elongated portion forming a support surface in an L-shape for the hanger.

11. The device according to claim 10, wherein the hook portion and the shank portion are made of a metal material.

12. The device according to claim 10, wherein the securing element is configured and arranged for adjustable positioning along the shank portion.

13. The device according to claim 10, further comprising at least one cap covering an exposed end of at least one of the hook portion, the shank portion, the U-shaped element, and the securing element.

14. The device according to claim 13, wherein the at least one cap is made of a plastic material.

15. A method for hanging a garment on a reinforced hanger, the method comprising:

providing the device according to claim 10;

providing a hanger;

placing the annular ring over a hook of the hanger;

placing the hook of the hanger within the U-shaped element;

positioning and tightening the securing element around the shank portion such that at least a portion of the hanger is supported by the support surface having an L-shape, thereby obtaining the reinforced hanger; and placing the garment on the reinforced hanger.

* * * * *